United States Patent [19]

Upton

[11] 4,334,585

[45] Jun. 15, 1982

[54] INSERT RETENTION AND COOLING APPARATUS FOR DRAG BITS

[75] Inventor: Robert G. Upton, Dana Point, Calif.

[73] Assignee: Smith International, Inc., Newport Beach, Calif.

[21] Appl. No.: 168,863

[22] Filed: Jul. 14, 1980

[51] Int. Cl.[3] ..... E21B 10/46

[52] U.S. Cl. ..... 175/329; 76/108 A; 175/393; 175/410

[58] Field of Search ..... 175/410, 340, 339, 329, 175/393; 299/81; 76/101 E, 108 A, DIG. 17

[56] References Cited

U.S. PATENT DOCUMENTS

| | | | |
|---|---|---|---|
| 3,113,630 | 12/1963 | Williams, Jr. | 175/340 |
| 3,838,742 | 10/1974 | Juvkan-Wald | 175/393 |
| 4,199,035 | 4/1980 | Thompson | 175/410 |
| 4,246,977 | 1/1981 | Allen | 175/410 |
| 4,253,533 | 3/1981 | Baker, III. | 175/410 |

*Primary Examiner*—William F. Pate, III

*Attorney, Agent, or Firm*—Robert G. Upton

[57] ABSTRACT

A one piece diamond drag bit is disclosed that utilizes individual diamond insert studs strategically placed into the face of the bit. Each insert is pinned in a "keyway" formed between a groove in the bit body and a complementary groove in the insert stud. A hollow locking pin locks each insert in place. Each pin communicates with a fluid chamber formed by the drag bit body and directs fluid over the cutting disk of each insert during operation of the drag bit.

8 Claims, 4 Drawing Figures

INSERT RETENTION AND COOLING APPARATUS FOR DRAG BITS

CROSS-REFERENCE TO RELATED APPLICATIONS

This invention relates to commonly assigned patent applications entitled DIAMOND STUDDED INSERT DRAG BIT WITH STRATEGICALLY LOCATED HYDRAULIC PASSAGES FOR MUD MOTORS, Ser. No. 28,629, and ECCENTRIC COUNTERBORE FOR DIAMOND INSERT STUD, Ser. No. 98,462.

BACKGROUND OF THE INVENTION

1. Field of the Invention

This invention relates to diamond studded drag bits.

More particularly, this invention teaches a means to prevent the diamond insert stud bodies from rotating in their interference fit sockets formed in the face of the bit body while simultaneously providing a conduit means to clean and cool each diamond faced stud as it works in a borehole.

2. Description of the Prior Art

Prior art rock bits that utilize chisel crested tungsten carbide inserts or diamond faced inserts on the cutting face of the bits sometimes have a problem with insert pulling or insert rotation while working in a formation. If these inserts should dislodge themselves from their interference fit sockets, the resultant "junk" in the borehole will soon destroy the rest of the bit. Chisel crested tungsten carbide and diamond studded inserts out of necessity have a specific orientation with respect to the cutting end of the rock bit to effect maximum hole penetration of the rock bit. If either of these inserts should rotate, bit penetration deteriorates markedly. Moreover, if the inserts are loosened due to rotation they are more likely to fall out of the bit, resulting in catastrophic failure of the bit.

U.S. Pat. No. 1,041,568 discloses a diamond drill wherein diamond tipped stud bodies are secured from rotation by notching the bit body. The body is so shaped to accept the rectangularly shaped stud.

Another prior art U.S. Pat. No. 4,073,354, discloses a drag type drill bit wherein the cutter retaining stud body is provided with an indexing means. A flat section in the body registers with a complementary receptacle in the face of the drag bit to prevent rotation of the cutter insert stud.

Both of the above patents however are disadvantaged in that, while the inserts are prevented from rotation, there is no means to cool and clean each insert while it works in the borehole. Consequently, the prior art bits easily "ball up", thus rendering the bits ineffective. Balling is caused by the sticky formation adhering to the cutting face of the bit. This occurs in certain formations where the hydraulic action of the drilling "mud" is inadequate. In addition, the hydraulic passages in the bit may be poorly designed, resulting in inefficient cross-flow of mud across the face of the bit.

The instant invention obviates these disadvantages by providing a means to prevent the diamond studded inserts from rotating while providing a means to cool and clean each insert while the bit penetrates the borehole.

SUMMARY OF THE INVENTION

It is an object of this invention to provide a means to prevent rotation of a diamond studded insert while, at the same time, providing a means to cool and clean each insert positioned in the face of a rock bit.

More specifically, it is an object of this invention to provide a cylindrical "key" that locks each insert by inserting the key in a "keyway" formed in the body of the bit and a wall of the insert stud body that is positioned in an interference fit receptacle formed in the face of a rock bit. The inner passageway of the cylindrical "key" communicates with a fluid chamber formed in the bit body so that cooling hydraulic fluid will wash over the cutting diamond face of the secured diamond insert stud during operation of the bit.

A diamond studded drag bit comprises a substantially cylindrical rock bit body having a first cutting end and a second pin end. The body forms a face at the first cutting end. A chamber is formed internally of the body. The chamber communicates with an opening formed in the second pin end. One or more diamond insert stud retention holes are strategically formed in the face of the bit body to position the diamond studded inserts retained within the holes for maximum penetration of a formation. An axially aligned groove is formed in a wall of a grip length of the diamond insert stud. The groove is oriented substantially in line with a diamond cutting disk attached to the insert. A second substantially axially aligned aperture is formed in a wall of the body forming each of the one or more insert retention holes in the face of the bit body. The second aperture is in communication with the chamber formed by the bit body. The second aperture is closed out when the diamond insert stud is inserted within the one or more stud retention holes. The groove in the wall of the stud is aligned with the second aperture.

A longitudinally extending pin means locks the insert within the face of the bit. The pin has first and second ends, the pin forming a longitudinal conduit therethrough from the first to the second end. The outside surface of the pin means is shaped to fit within the second aperture formed between the bit body and the groove in the wall of the diamond insert stud. The pin serves to lock the diamond insert stud within the face of the rock bit. The longitudinal conduit in the pin serves to direct a fluid in the chamber formed by the rock bit over the diamond cutting disk of the diamond insert stud during operation of the rock bit.

An advantage then over the prior art is the locking feature of the present invention that prevents rotation of the inserts within their receptacles while serving as a conduit for cooling and cleaning fluid emanating from within the rock bit body.

Still another advantage over the prior art is the capability to clean each of the individual diamond inserts, thus minimizing any balling tendency of the drag bit as it works in a borehole.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
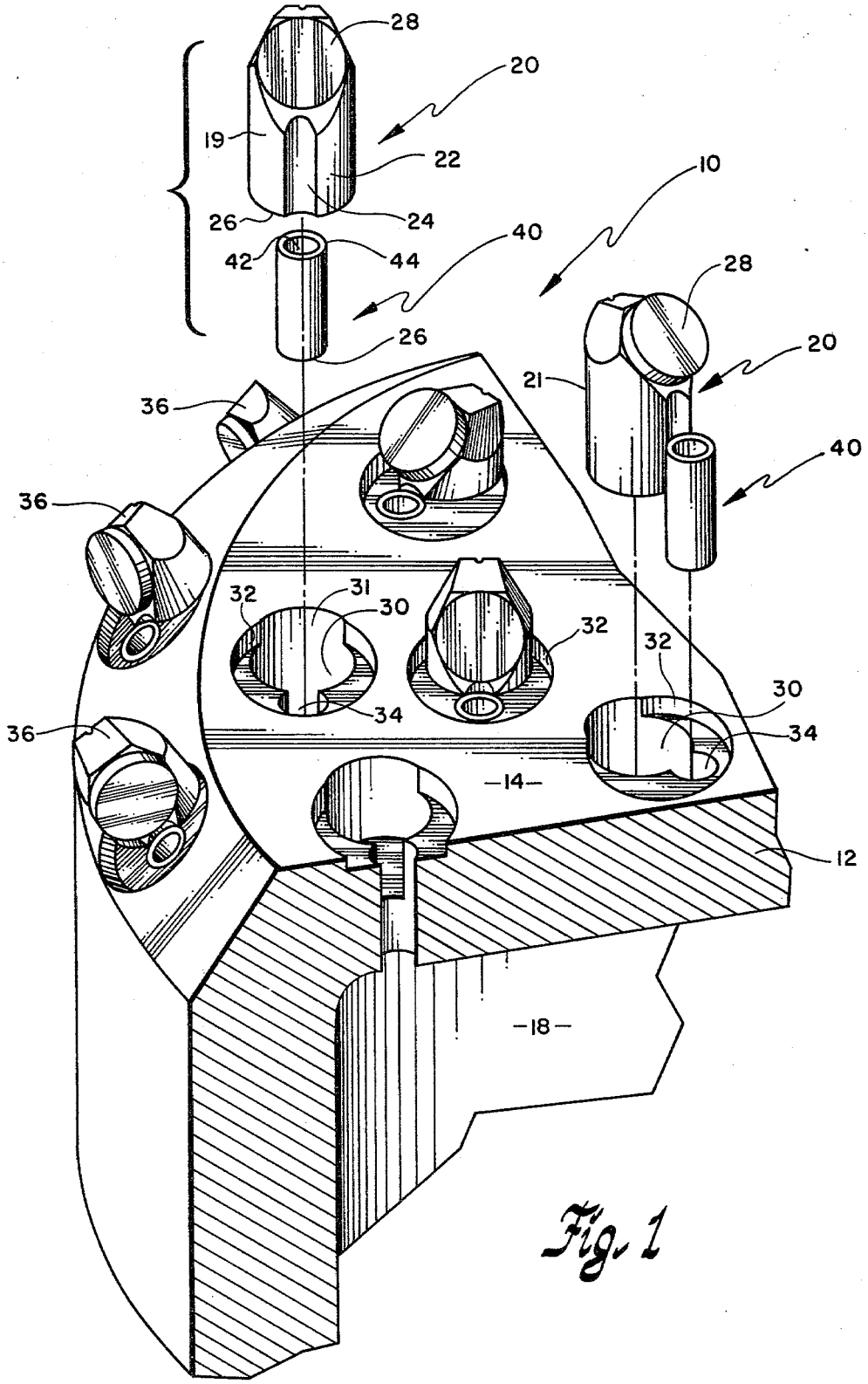
FIG. 1 is a perspective view, partially broken away, of a drag bit body with some of the diamond insert studs exploded out of the face of the bit.

Turning now to FIG. 1, the drag bit, generally designated as 10, consists of bit body 12 which forms a bit face 14 at the cutting end of the bit. The drag bit body 12 forms a gage surface 16 near the cutting end of the bit, the bit extending to the opposite pin end (not shown). The bit body forms an inner hydraulic chamber 18 which communicates with an aperture in the end of the pin.

A series of insert retention holes 30 are strategically placed and subsequently drilled in the face 14 of the bit body 12. The insert retention holes are generally drilled slightly undersize to provide an interference type fit when the inserts are inserted in the hole.

A plurality of diamond faced inserts, generally designated as 20, comprise an insert stud body 19 with a grip length 22 at the lower end of the stud body 19. At the cutting tip of the stud 19 is attached a diamond disk 28. The opposite base end 26 seats against the bottom of the insert retention hole 30.

The insert blanks or studs 20, for example, are fabricated from a tungsten carbide substrate with a diamond layer sintered to a face of a substrate. The diamond layer is composed of a polycrystalline material. The synthetic polycrystalline diamond layer is manufactured by the Specialty Material Department of General Electric Company of Worthington, Ohio. The foregoing drill cutter blank or diamond insert is known by the trademark name of Stratapax drill blanks. The series of inserts 20 are strategically placed within face 14 of drag bit body 12 to best advance the drill bit in a borehole. A series of gage row diamond inserts 36 are positioned around the peripheral edge or gage surface 16 of bit body 12 to cut the gage of the borehole.

Grip length 22 of stud body 19 forms a groove or slot 24 that is substantially aligned with the axis of the stud body 19. The groove 24 in the peripheral wall of the body 19 is substantially aligned with the face of diamond disk 28. When the insert 20 is interference fitted within its receptacle 30 in face 14 of bit body 12, the groove 24 closes out a secondary hole 34 formed in face 14 of body 12. The secondary aperture or hole 34 is drilled completely through face 14 into the chamber 18 formed by body 12 of the rock bit. A wall 31, opposite to the aperture 34, provides support for the back surface of body 19, the back surface 21 being opposite the groove 24 in the stud body 19. An eccentric counterbore 32 in face 14 of body 12 relieves the portion of the diamond studded insert that extends below the face 14 of the body 12. In other words, the bottom edge of the diamond disk 28 extends below the surface 14 of bit body 12 and the relieved portion of eccentric hole 32 provides clearance for the bottom edge of diamond disk 28. The back surface 31, however, conforms to the diameter of the insert thus providing additional support for the stud body 19 of insert 20 to help prevent the insert from shearing off along face 14 during operation of the drag bit 10. A locking pin, generally designated as 40, has a conduit 42 through the center of the pin that defines an exit end 44 nearest the diamond cutting disk 28 and a fluid entrance end 46 adjacent chamber 18. the pin 40 is first inserted in hole 34, followed by insertion of the insert 20 within receptacle 30 with the groove 24 aligned with and closing out the pin retention hole 34. The insert 20 is then locked within receptacle 30 in face 14 of rock bit body 12.

The positioning of the eccentric counterbore 32, as well as the location of the pin retention hole 34 adjacent hole 30, determines the orientation of the diamond disk 28 with respect to the rock bit. Obviously this orientation is important to effect maximum hole penetration by the drag bit.

During operation, fluid within chamber 18 is directed through conduit 42, defined by the pin 40, and over the diamond disk 28 in each diamond insert. The fluid or hydraulic mud directed through conduit 42 obviously cools and cleans the cutting face of the diamond disk 28 as it works in the hole. By providing each of the diamond inserts with its own hydraulic passage, balling of the bit is substantially eliminated. Multiple passages additionally provide adequate flow of hydraulic mud across the face 14 of drag bit 10.

The diamond gage row inserts 36 cut the gage of the borehole to maintain the proper diameter of the borehole (not shown) as the rock bit is advanced in the formation.

Figure 2:
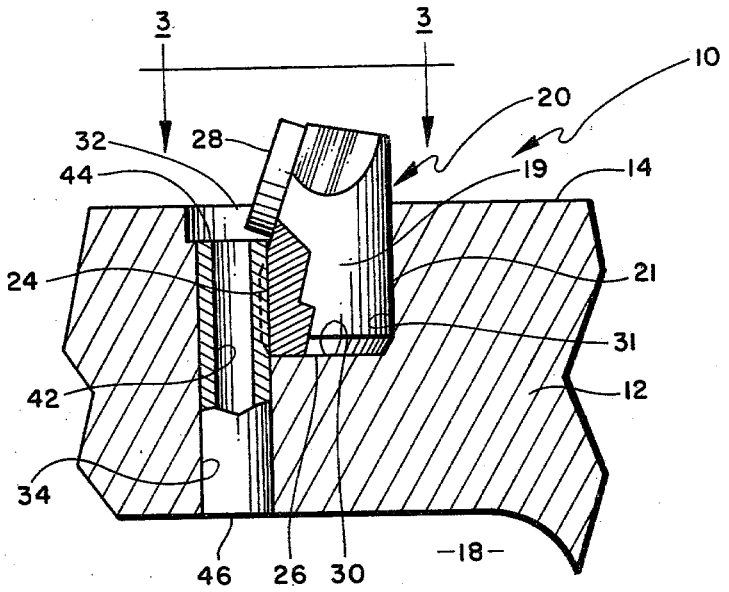
FIG. 2 is a partially broken away cross section of the drag bit illustrating the relationship of the grooved insert with the conduit insert retention pin communicating with the fluid chamber within the bit.

Turning now to FIG. 2, the partial cross section of the rock bit 10 illustrates the inserts 20 locked into its receptacle 30 with the base 26 of the insert pressed against the floor of the retention hole. In addition, the eccentric hole 32 is shown providing clearance for the bottom edge of the diamond disk 28. This view also illustrates that the back surface 21 of insert stud body 19 is supported along back surface 31. The additional depth of the counterbore 32 thus provides added support for the body 19. The aperture 34 is drilled completely through the body 12 into the fluid chamber 18, defined by the rock bit, as previously described. The pin 40 is inserted within this aperture and the aperture is closed out by the slot or groove 24 in the exterior wall of body 19 of insert 20. Thus the pin locks the insert within face 14 of the bit body 12. The internal passage or conduit 42, of course, directs fluid from chamber 18 into entrance opening 46 and out through exit end 44 over the face of the diamond disk 28.

Figure 3:
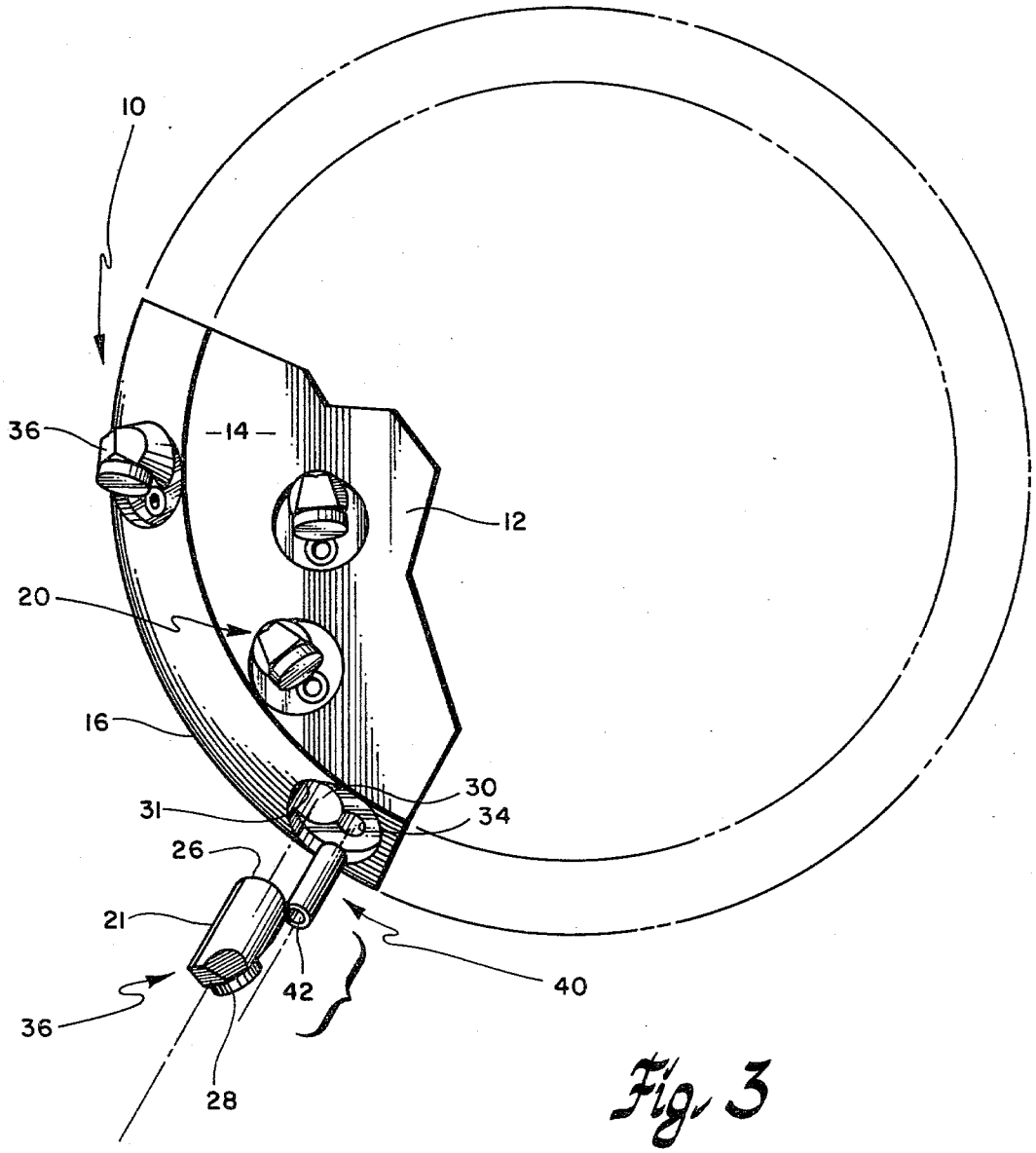
FIG. 3 is a partially broken away top view taken through 3—3 of FIG. 2 with a gage row diamond insert exploded from the fragmented view.

With reference now to FIG. 3, the partially broken away top view clearly illustrates the orientation of each of the inserts 20 and the gage row orientation of each of the inserts 36. The pins 40 determine the substantially radial orientation of the cutting face of each of the diamond disks attached to insert bodies 19 to effect maximum hole penetration. The exploded diamond inserts 36 depict the steps in which the inserts are inserted within their receptacles 30. The pin 40 is first inserted within its pin retention hole 34, followed by insertion of the insert 36 with the slot 24 in the insert aligned with the pin which is now overlapping the insert retention hole 30. The insert then is pressed into its receptacle 30 with the bottom 26 contacting the bottom of the receptacle 30, the pin 40 locking each insert in place within the rock bit body.

Figure 4:
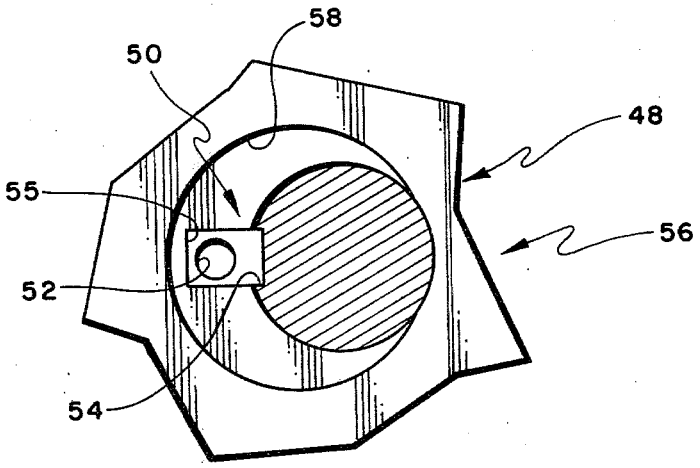
FIG. 4 is a partially broken away top view of an alternate insert locking pin.

Turning now to FIG. 4, this fragmented top view illustrates an alternative embodiment wherein the locking pin 50 is rectangular in shape. The complementary axially aligned slot 54, within the grip length or exterior wall of the insert 48, is aligned with the rectangularly shaped passageway 55 in the drag bit 56. The slot 55 is milled in the wall formed by the retention hole in the bit 56 through the counterbore opening 58 formed within the face of the bit 56. A longitudinally extending conduit 52 is drilled through the pin 50 to direct fluid within the rock bit over the diamond cutting face of the insert 48.

The locking pin, with its internal conduit, would preferably be fabricated from tungsten carbide. The pin may, of course, be fabricated from other suitable wear and abrasion resistant material. In addition, the hollow pin and its complementary retention hole may be circular, rectangular or hexagonal in shape without departing from the scope of this invention. The pin may be interference fitted with hole 34 or it may be metallurgically bonded therein.

The locked-in-place inserts may be other than diamond studded inserts. For example, the inserts could be elongated chisel crested tungsten carbide inserts, especially of the type used in soft formations.

In addition, the locked-in-place inserts, whether they are diamond studded or chisel crested inserts, may be used in hybrid drag/multi-coned rock bits.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A rock bit comprising:

a drag bit portion of said rock bit having a first cutting end, said drag bit portion forming a face at said first cutting end, said drag bit portion further forming a first chamber therein that communicates with a second chamber defined in a body of said rock bit, said second chamber communicating with an opening formed in an inlet end of said body of said rock bit, one or more diamond insert stud retention holes is strategically formed in said face of said drag bit portion to position one or more diamond studded inserts within said holes for maximum penetration of an earth formation, a groove formed in a wall of a grip length of said diamond insert stud, said groove being substantially axially aligned with said stud, said groove being oriented substantially in line with a diamond cutting disk attached to said insert, a second aperture formed in each wall of said insert holes in said face of said drag bit portion, said second aperture being substantially axially aligned with said insert holes, said second aperture is in communication with said first chamber formed by said drag bit portion, said second aperture being closed out when said diamond insert stud is inserted within said one or more stud retention holes, said groove in said wall of said stud is aligned with said second aperture in said wall of said insert retention hole, and a longitudinally extending insert retention pin having first and second ends, said pin forming a longitudinal conduit therethrough from said first to said second end, the outside surface of said pin means being shaped to fit within said second aperture formed between said drag bit portion and said groove in said wall of said diamond insert stud, said pin serving to lock said diamond insert stud within said face of said rock bit, said longitudinal conduit in said pin serving to direct a fluid in said first chamber over the diamond cutting disk of said diamond insert stud during operation of said rock bit.

2. The invention as set forth in claim 1 wherein said rock bit is a one piece drag type rock bit.

3. The invention as set forth in claim 1 wherein said insert retention pin is fabricated from tungsten carbide material.

4. The invention as set forth in claim 3 wherein said insert retention pin is interference fitted within said second aperture.

5. The invention as set forth in claim 4 wherein said insert retention pin is circular in cross section.

6. A method of retaining, cooling and cleaning one or more diamond insert studs within a cutting end face formed by a drag bit portion of a rock bit body comprising the steps of:

forming a first hydraulic chamber within said drag bit portion, said chamber communicating with a second chamber formed within said rock bit body, forming one or more strategically positioned insert retention holes in said face of said drag bit portion to position each of said one or more inserts to optimize the rock bit penetration rate during operation of said drag bit, forming a second aperture in a wall of each of said insert holes, said second aperture being substantially axially aligned with said insert hole, said aperture further communicating with said chamber within said drag bit portion of said rock bit, forming a groove in a wall of a grip length of said insert stud, said groove being substantially axially aligned with said stud, said groove being further substantially aligned with a cutting face of said diamond insert stud, said groove when said insert is inserted within said insert retention hole closes out said second aperture in said wall of said insert hole, inserting a hollow insert retention pin within said second aperture, a portion of said pin extending into said insert retention hole, and inserting said one or more diamond insert studs within said one or more insert retention holes, said groove in a wall of said insert being aligned with said insert retention pin retained within said second aperture in said wall of said insert retention hole, said hollow insert retention pin locking said diamond insert within its insert retention hole, said hollow insert retention pin directing hydraulic fluid from within said first chamber over said cutting face of said diamond insert stud thereby cooling and cleaning said cutting face of said one or more studs inserted within said cutting end face during operation of said rock bit.

7. A diamond studded rock bit comprising:

a substantially cylindrical rock bit body having a first cutting end and a second pin end, said body forming a face at said first cutting end, said body further forming a chamber internally of said body, said chamber communicating with an opening formed in said second pin end of said body, one or more diamond insert stud retention holes being strategically formed in said face of said bit body to position one or more diamond studded inserts within said holes for maximum penetration of a formation, a groove formed in a wall of a grip length of said diamond insert stud, said groove being substantially axially aligned with said stud, said groove being oriented substantially in line with a diamond cutting disk attached to said insert, a second aperture formed in each wall of said insert holes in said face of said bit body, said second aperture being substantially axially aligned with said insert holes, said second aperture being in communication with said chamber formed by said bit body, said second aperture being closed out when said diamond insert stud is inserted within said one or more stud retention holes, said groove in said wall of said stud being aligned with said second aperture in said wall of said insert retention hole, and a longitudinally extending insert retention pin having first and second ends, said pin forming a longitudinal conduit therethrough from said first to said second end, the outside surface of said pin means being shaped to fit within said second aperture formed between said bit body and said groove in said wall of said diamond insert stud, said insert retention pin is rectangular in cross section, said groove in a wall of a grip length of said diamond insert stud and said second aperture formed in each wall of said insert holes being of complementary rectangular shape to accept said rectangular retention pin, said pin serving to lock said diamond insert stud within said face of said rock bit, said longitudinal conduit in said pin serving to direct a fluid in said chamber over the diamond cutting disk of said diamond insert stud during operation of said rock bit.

8. The invention as set forth in claim 1 wherein said rock bit is a hybrid rock bit with a cutting end consisting of one or more roller cones and drag bit portions extending from said body of said rock bit.

* * * * *